United States Patent [19]

Muller et al.

[11] Patent Number: 4,743,524

[45] Date of Patent: May 10, 1988

[54] DIAZOTYPE COMPOSITION WITH A NON-MIGRATING YELLOW COUPLER OF CONTROLLED COUPLING ENERGY

[75] Inventors: Peter Muller; Henry Mustacchi, both of Port Washington; Leonard Kreicas, Long Island, all of N.Y.

[73] Assignee: Andrews Paper & Chemical Co., Inc., Port Washington, N.Y.

[21] Appl. No.: 919,970

[22] Filed: Oct. 17, 1986

[51] Int. Cl.[4] ..... G03C 1/58

[52] U.S. Cl. ..... 430/182; 430/148; 430/173; 430/180

[58] Field of Search ..... 430/182, 173

[56] References Cited

U.S. PATENT DOCUMENTS

| | | | |
|---|---|---|---|
| 2,551,133 | 5/1951 | Jennings et al. | 430/182 |
| 2,552,355 | 5/1951 | Von Glahn et al. | 430/182 |
| 3,149,972 | 9/1964 | Herrick et al. | 430/182 |
| 3,459,790 | 8/1969 | Smith | 430/510 |
| 4,012,260 | 3/1977 | Dickerson et al. | 430/428 |
| 4,032,344 | 6/1977 | Fletcher et al. | 430/176 |
| 4,215,041 | 7/1980 | Philipot et al. | 430/175 |

*Primary Examiner*—Charles L. Bowers, Jr.

*Attorney, Agent, or Firm*—Kane, Dalsimer, Sullivan, Kurucz, Levy, Eisele and Richard

[57] ABSTRACT

Diazotypes with new yellow coupler with an active methylene group are disclosed; the couplers do not migrate and excel by their relatively reduced coupling speed for greatly improved shelf life of diazotypes. In preferred embodiments the improved new diazotypes contain acetoacetoxyethyl methacrylate or acrylate as yellow coupler.

4 Claims, No Drawings

DIAZOTYPE COMPOSITION WITH A NON-MIGRATING YELLOW COUPLER OF CONTROLLED COUPLING ENERGY

BACKGROUND OF THE INVENTION

1. Field of the Invention

The invention relates to diazotype compositions and their use in diazotype reproductions.

2. Brief Description of the Prior Art

The diazotype reproduction process is well-known to the art and is described in great detail in "Light Sensitive Systems" by Jaromir Kosar, John Wiley & Sons, Inc., N.Y. 1965, and in "Reproduction Coating" by E. Jahoda, 4th Edition, Andrews Paper & Chemical Co., Inc., Port Washington, N.Y.

In general, diazotype reproduction prints are obtained by an imagewise exposure of a light-sensitive diazo material to ultraviolet light followed by development of the exposed diazotype material. There are several different methods available to develop the latent image imposed on the light-sensitive diazo material by the light exposure including ammonia development, amine development, thermal development and moist (liquid) development.

The light-sensitive diazo material generally comprises a light-sensitive diazo composition affixed to a support base such as paper or a synthetic polymeric resin film such as polyethylene terephthalate film, cellulose acetate, or a like base support. The light-sensitive diazo composition may comprise a light-sensitive diazonium salt compound in admixture with diazo enhancing compounds. Upon exposure of the light-sensitive diazonium compound to ultraviolet light through a translucent original having opaque image portions, the unmasked portions of the diazonium salt are decomposed by the ultraviolet radiation whereas the masked portions are left undecomposed. The latent image created by the imagewise exposure may then be developed by the methods described above.

Diazotype materials on paper and film are manufactured in different print colors such as black, blue, yellow, brown and red which use azo dyes generated from one or more diazo compounds and one and more couplers depending on the desired print color shade and printing speed.

Diazotype papers are generally coated with aqueous diazotype preparations while diazotype films are usually sensitized with organic solvent based preparations.

There are only a few applications of yellow diazotypes such as in transparent films for overhead projectors or diazotypes for a very high actinic opacity since the yellow dyes absorb UV light. There is a need, however, for yellow couplers in blackline diazotypes which use a combination of blue-, yellow-, and often together with brown couplers to arrive at a neutral black print color.

Conventional yellow couplers can be classified into two groups with respect to their coupling rates. Classified in descending order, they are:

1. fast coupling compounds:
   aceto-acet anilide
   bis aceto-acet ethylene diamide
   aceto-acet-m-hydroxy anilide
   aceto-acet-benzylamide; and
2. medium to slow coupling compounds:
   cyanoacetmorpholide diacyanoacet-triethylene tetramine
   m-hydroxy phenyl urea
   catechol monohydroxy ethyl ether
   o-phenyl phenol The first group of yellow couplers can be used only to a very limited degree because they are very difficult to stabilize for an acceptable shelf life of diazotypes, and they couple too fast when they are used to generate complementary azo dyes with the blue dyes obtained from conventional blue couplers in blackline diazotypes. Moreover, they tend to migrate within the coating layer or into the film base or paper upon shelf aging.

The second group of yellow couplers couples too slow when used as the only yellow components to complement conventional blue couplers for the generation of blackline diazotypes, resulting in unsatisfactory and off-shade colors.

It is an objective of this invention to overcome the above shortcomings and to offer a means to produce diazotypes with yellow coupling components that permit the generation of diazotypes with improved shade control, rate of development, and shelf life.

SUMMARY OF THE INVENTION

The invention comprises a light-sensitive diazo coating composition which comprises;

(A) an azo coupler which is a compound of the formula:

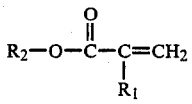

(I)

wherein $R_1$ is selected from the group consisting of hydrogen or lower alkyl and $R_2$ is selected from the group consisting of acetoacetoxyalkyl in a proportion sufficient to couple the diazonium compound (B) described below;

(B) a light-sensitive diazonium compound; and (C) a stabilizing proportion of an acid stabilizer.

In the formula (I) given above, $R_1$ is preferably methyl.

The invention also comprises diazotype films which comprise a base support coated with the composition of the invention.

The term "light-sensitive" as used herein means the compound or material undergoes photolytic decomposition.

The term "lower alkyl" is used herein to mean alkyl of 1 to 5 carbon atoms, inclusive.

The advantages of the novel diazotype compositions of the invention include improved blackline diazotypes that develop more readily without sacrificing shelf life and generate more consistent neutral shades with good light fastness. Similar advantages are obtained in yellow or brownline intermediate diazotypes which excel by their light fastness and reprint opacity.

DETAILED DESCRIPTION OF THE INVENTION

We have found that aceto acetic acid-esters of the formula (I) given above when used as couplers in diazotype compositions and when compared with conventional acetoacetic acid amide derivatives couplers:

1. reduce the rate of the coupling reaction to an acceptable level which is very much in line with the coupling rate of conventional blue couplers, such as:

2,3-dihydroxy naphthalene;

2,3-dihydroxy-naphthalene-6-sulfonic acid;

2,3-hydroxy-3-naphthoic acid-morpholino propylamide; and the like;

2. need no special stabilization for satisfactory shelf life for use in diazotypes;
3. do not tend to migrate from the composition on a support; and
4. product print dyes of better light fastness.

The yellow coupling compounds used in the invention comprise esters of acetoacetic acid of alkoxy-acyl radicals in which the acyl group contains some unsaturation such as acrylic or methacrylic radicals.

Esters of the formula (I) given above are well known compounds as are the methods of their preparation; see for example the description in U.S. Pat. No. 3,459,790, the disclosure of which is hereby incorporated by reference thereto.

Preferred for use as a coupler in the compositions of the invention is acetoacetethoxy methacrylate of formula:

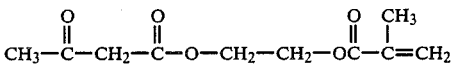

(III)

as representative of the methacrylate and acrylate esters of the hydroxyalkyl ester of aceto acetic acid.

While the theoretical reasons for the beneficial effects obtained from the use of the new coupling component are not fully understood, it is assumed that the usually extremely high coupling rate of the couplers with an active methylene group is reduced through the introduction of the relatively long chain of the acyl-oxyalkyl-ester radical. It can be further assumed that the unsaturation in the acyl group may undergo a crosslinking reaction within the diazotype coating layer and thus prevent coupler migration. However, applicants are not to be bound by any theory by which the compositions of the invention are found advantageous.

Any conventional and known diazonium compound may be employed as the diazonium compound component of the compositions of the invention. Advantageously, the diazonium compound component may be represented by:

1. Derivatives of 1-diazo-4-amine benzene with or without alkyl, oxylalkyl or halogen substitutions in the benzene ring and with alkyl or dialkyl or acyl or acyl-alkyl substitution on the amino nitrogen or with the amino nitrogen forming a member of a heterocyclic ring with or without a second hetero atom of oxygen or nitrogen.
2. Derivatives of 1-diazo-4-alkylaryl mercapto benzene with or without substitution in the benzene ring.
3. Derivatives of 1-diazo-4-phenyl benzene with and without substitution in the phenyl and in the benzene rings.
4. 2-diazo-1-hydroxy-naphthalene-5-sulfonic acid, and the like.

In preferred compositions of the invention, the azo couplers (I) are mixed with the diazonium compounds in an acid environment to prevent precoupling. When changing the pH from an acid to an alkaline pH, the coupling reaction occurs to produce an azo dye as is known in the art. The acid stabilizers are well known compounds also, as is the method of their preparation. Representative of such acid stabilizers are citric acid, tartaric acid, hydrochloric acid, sulfuric acid, boric acid, sulfosalicylic acid, formic acid, acetic acid, zinc chloride or stannic chloride mixtures thereof and the like. A stabilizing proportion of acid is one which will maintain the desired acid pH of the diazo composition or coating until development occurs. In general, a stabilizing proportion of the acid will be within the range from about 5 gms to about 200 gms (preferably 20 gms to 70 gms) of acid for each liter of diazo coating composition to be stabilized.

The light-sensitive diazo coating compositions of the invention may contain any number of additional ingredients conventionally used in the preparation of prior art light-sensitive diazo coating compositions such as, for example, glycerol, polypropylene glycol, urea, thiourea, alkyl and dialkyl thioureas, hydroxyethyl-allylthiourea, dialkylureas, hydroxy benzophenone, Benzotriazole, alkyl, chloro-or hydroxybenzotriazoles, hydroxy alkyl benzimidazole, caprolactam and the like to minimize the necessary ammonia or amine concentration in the developing environment to act as:

1. development accelerators;
2. antioxidants to further stabilize diazotype prints against discoloration under daylight exposure;
3. contrast controlling compounds;
4. solubilizers which improve the compatibility of the various components in the sensitizing solution; and
5. shaders to shift colors toward more desirable hues and development.

Sometimes such additional components fulfill more than one of these functions.

The diazo compositions of the invention may be prepared by bringing the ingredients together in a suitable vessel. Preferably the diazo compositions of the invention are prepared in an organic solvent or aqueous media or mixed solvent-aqueous media for use as an aqueous coating mixture to prepare diazotype reproduction materials of the invention. In case of precoating it is possible to add one or more components to a precoat preparation and at least one of the remaining components of the compositions of this invention to a secondary coating preparation.

The proportions of the various components of the compositions of the invention described above may be those proportions conventionally used in their use prior to this invention, in the preparation of prior art diazo light-sensitive compositions (where they were so used). These proportions are well known to those skilled in the art; see for example the disclosures of Kosar, supra. and of U.S. Pat. Nos. 3,923,518 and 3,966,056. In general, the diazo coating compositions contain from about 0.1 to about 10 percent by weight of the light-sensitive diazonium compound and sufficient coupler to react with and couple the diazonium compound upon development.

The diazotype reproduction materials of the invention may be prepared by coating mixtures of the diazo compositions of the invention on a suitable base support material, using conventional diazo coating apparatus. The techniques are well known; see for example U.S. Pat. Nos. 3,923,518 and 3,996,056. Representative of suitable base supports are thermoplastic, polymeric resin films, foils including metal foils, cloth, opaque paper, translucent papers and like supports. Preferred are the commercially available diazobase films.

Coating layers of the invention also may contain polymer resins as binders such as cellulosic esters, polyvinyl esters, polyacrylates as well as pigments to influence the writing characteristics of the film surface, and/or to generate a light scattering effect to increase printing speed, visual and reprint dye density. Such pigments may be alumina, silicas, silicates or the like.

The following examples describe the manner and method of making and using the invention and set forth the best mode contemplated by the inventors but are not to be construed as limiting. All parts specified are by weight unless otherwise stated. Where indicated, the following test procedure was followed:

Accelerated Aging Test

Diazotype sheets are exposed for 24 hours at 50° C. to atmosphere of 75% relative humidity. Thereafter they are half covered with a black opaque sheet and exposed to UV light in the printing section of a diazo copying machine, sufficiently to decompose all diazo in the non-covered area. The sheets are then fully developed with ammonia by passing the diazotype sheet through the developing section of a diazotype copying machine. A fresh sheet of the same diazotype paper is also half covered with a black opaque sheet and printed and developed in the same manner. The resulting prints are then measured in a Photo Volt Reflection Densitometer to determine the reflection densities of the bleached out areas (whites) and of the fully-developed areas (full tones). The differences of reflection densities from the aged and non-aged sheets of the white areas are recorded as print background discoloration from aging and of the full tones as print dye loss from aging. The aging test with a 50 percent relative humidity (R.H.) atmosphere, in general, reflects a normal shelf life of three months. The aging test with a 75 percent R.H. atmosphere reflects behavior under extremely adverse conditions.

EXAMPLE 1

A solution is prepared with the following components:

| | |
|---|---|
| methyl ethyl ketone | 350 ml |
| methyl alcohol | 350 ml |
| ethylene glycol mono ethyl ether | 250 ml |
| sulfosalicyclic acid | 5 g |
| thiourea | 2.5 g |
| acetoacet oxyethyl methacrylate | 3 g |
| 2-hydroxy-3-naphthoic acid ethanolamide | 5 g |
| 5-chlororesorcinol | 1 g |
| 1-diazo-2,5-dibutoxy-4-morpholino benzene-sulfo-iso-phthalate | 25 g |

The solution is evenly applied to a polyester film which was first coated with a cellulose acetate propionate lacquer, at a rate of 40 ml per square meter and dried.

Upon imagewise exposure and ammonia development in a commercial diazotype copying machine, a transparent diazotype copy was obtained with deep black lines in the opaque areas and with neutral grey lines in the half tones or the original on a clear non-discolored background.

An accelerated aging test of the sensitized material at 50° C. and 75% RH for 24 hours with imagewise exposure and development afterwards resulted in prints with insignificant loss in print line density and print background discoloration.

EXAMPLE 2

This is not an example of the invention, but is made for purposes of comparison.

The procedure of Example 1, supra., was repeated except for replacement of acetoacet oxyethyl methacrylate by equal proportions of various acetoacet acid amide derivatives. The results obtained are given in the Table, below.

TABLE

| | Observations | | | | |
|---|---|---|---|---|---|
| | Immediately | | Upon Accelerated Aging | | |
| Coupler | Full Tone | Half Tone | Full Tone | Half Tone | Background |
| Aceto acet anilide | greenish black | yellow | blueish black | greenish yellow | yellow |
| Bis aceto acet ethylene diamide | greenish black | greenish yellow | blueish black | greenish | yellow |
| Aceto acet-m-hydroxy anilide | greenish black | greenish yellow | blueish black | greenish | yellow |
| Aceto acet-benzylamide | greenish black | greenish | blueish black | greenish | yellow |

When compared with Example 1, the results indicate that the four couplers of Example 2 give unsatisfactory results.

EXAMPLE 3

A solution was prepared with the following components:

| | |
|---|---|
| methyl ethyl ketone | 450 ml |
| isopropanol | 250 ml |
| ethylene glycol mono ethyl ether | 250 ml |
| sulfosalicyclic acid | 5 g |
| stannic chloride | 1.5 g |
| acetoacet oxyethyl methacrylate | 10 g |
| 1-diazo-2,5-diethoxy-4-p-tolyl mercapto benzene borofluoride | 10 g |

The solution was applied as described above in Example 1, supra.

Upon imagewise exposure and ammonia development in a commercial diazotype copying machine, a transparent diazotype copy was obtained with bright yellow lines on a clear non-discolored background. The yellow print lines exhibited an excellent reprint opacity. Accelerated aging tests at 50° C. and 75% R.H. for 24 hours indicate a good shelf life for the film.

When the 1-diazo-2,5-diethoxy-4-p-tolyl mercapto benzene borofluoride was replaced by an equal proportion of 1-diazo-3- chloro-4-N-methyl-N-cyclohexyl amino benzene chloride ½ zinc chloride, a slightly darker tan-yellow copy was obtained with otherwise very similar qualities for the diazotype film.

When the yellow coupler acetoacet oxyethyl methacrylate was replaced by an equal proportion of one the following:

aceto-acet anilide;
bis-aceto-acet-ethylene diamide;
aceto-acet m-hydroxy anilide; or
aceto-acet-benzylamide precoupling occurred in the sensitizing solutions after a short time. Prints had an unacceptable yellow background. Accelerated aging tests resulted in copies with a deep yellow background.

EXAMPLE 4

In a diazotype coating machine equipped with three airknife coating stations for precoating, sensitizing and backcoating and with a high velocity hot air convection dryer pass after each coating station, a 100% rag paper of 53 g/m$^2$ basis weight which was transparentized through impregnation with a polystyrene resin increasing the basis weight to 61 g/m$^2$ was precoated with a preparation of:

| | |
|---|---|
| water | 6,000 ml |
| silica (partical size 1 micron) | 500 g |
| 50% aqueous dispersion of polyvinylacetate (homopolymer) | 800 ml |
| antifoam agent | 10 g |
| water, complete to a total of | 10,000 ml |

After drying the paper was overcoated with a sensitizing preparation of:

| | |
|---|---|
| water | 6,000 ml |
| sulfosalicylic acid | 150 g |
| isopropyl alcohol | 2,500 ml |
| butylcellosolve | 500 ml |
| acetoacet oxyethyl methacrylate | 90 g |
| 2-hydroxy-3-naphthoic acid morpholino propylamide | 80 g |
| 1-diazo-2,5-diethoxy-morpholino benzene hydrogenesulfate | 200 g |
| 1-diazo-3-methyl-4-pyrrolidino-benzene chloride, zinc chloride salt | 150 g |
| zinc chloride | 150 g |
| wetting agent | 5 g |
| water, to complete to a total of | 10,000 ml |

After drying the sensitized paper was backcoated for curl control with a preparation of:

| | |
|---|---|
| water | 10,000 ml |
| citric acid | 10 g |

After drying to a residual moisture of 3.5% the paper was wound up.

A sample sheet of the coated paper was imagewise exposed and ammonia developed in a commercial diazotype copying machine. A transparent diazotype copy was obtained with black print lines on a translucent background. When the copy was used as a second original to make reprints on opaque diazotype paper, copies of good contrast were obtained. The blackline copies of the Example 4 reproduced easily also on xerographic copiers and on silver halide microfilms.

An accelerated aging test of the sensitized material at 50° C. and 75% RH for 24 hours with imagewise exposure and development afterwares resulted in prints with insignificant loss in print line density and print background discoloration.

What is claimed is:

1. A light-sensitive diazo coating composition which comprises;

a mixture of (A) an azo coupler which is a compound of the formula:

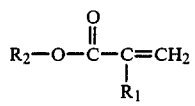

(I)

wherein $R_1$ is selected from the group consisting of hydrogen or lower alkyl and wherein $R_2$ is selected from the group consisting of acetoacetyloxyalkyl, in a proportion sufficient to couple the diazonium compound (B) described below;

(B) a light-sensitive diazonium compound; and (C) a stabilizing proportion of an acid stabilizer.

2. The composition of claim 1 wherein the compound of formula (I) is selected from the group consisting of methacrylate and acrylate esters of the hydroxyalkylester of aceto acetic acid.

3. The composition of claim 2 wherein the compound is acetoacet oxyethyl methacrylate.

4. A light sensitive diazotype reproduction material which comprises:

a base support; and a coating on the support, which comprises the composition of claim 1.

* * * * *